US009523504B2

(12) United States Patent
Steele

(10) Patent No.: US 9,523,504 B2
(45) Date of Patent: Dec. 20, 2016

(54) FUEL MANIFOLD AND FUEL INJECTOR ARRANGEMENT

(71) Applicant: ROLLS-ROYCE PLC, London (GB)

(72) Inventor: David Steele, Cheltenham (GB)

(73) Assignee: ROLLS-ROYCE plc, London (GB)

( * ) Notice: Subject to any disclaimer, the term of this patent is extended or adjusted under 35 U.S.C. 154(b) by 83 days.

(21) Appl. No.: 14/718,784

(22) Filed: May 21, 2015

(65) Prior Publication Data

US 2015/0361897 A1 Dec. 17, 2015

(30) Foreign Application Priority Data

Jun. 13, 2014 (GB) ..... 1410607.4

(51) Int. Cl.
*F23R 3/28* (2006.01)

(52) U.S. Cl.
CPC ..... *F23R 3/283* (2013.01); *F23R 2900/00005* (2013.01); *F23R 2900/00012* (2013.01)

(58) Field of Classification Search
CPC ..... F23R 3/283; F23R 2900/00005; F23R 2900/00012
USPC ..... 60/739
See application file for complete search history.

(56) References Cited

U.S. PATENT DOCUMENTS 6,761,035 B1 7/2004 Mueller
8,353,166 B2 * 1/2013 Morenko ..... F02C 3/14 60/739
9,429,326 B2 * 8/2016 Kato ..... F23R 3/36
2004/0129001 A1 * 7/2004 Lehtinen ..... F23D 11/107 60/740
2010/0044472 A1 * 2/2010 Smith ..... F02M 53/04 239/589
2010/0307159 A1 * 12/2010 Toon ..... F23D 11/38 60/746

FOREIGN PATENT DOCUMENTS

GB 2461503 A 1/2010
GB 2462915 A 3/2010
RU 2 375 597 C2 12/2009

OTHER PUBLICATIONS

Jan. 15, 2015 Search Report issued in Application No. GB1410607.4.

* cited by examiner

*Primary Examiner* — Corey Skurdal
(74) *Attorney, Agent, or Firm* — Oliff PLC

(57) ABSTRACT

A fuel manifold and fuel injector arrangement comprises an annular fuel manifold and a plurality of fuel injectors. Each fuel injector comprises a fuel injector head and a hollow fuel feed arm. Each fuel injector has a pipe to supply fuel to the fuel injector head. The pipe extends from the fuel feed arm and through a corresponding aperture in the casing. The annular fuel manifold is arranged around the casing and the annular fuel manifold comprises a plurality of connectors. Each connector has a socket aligned with a corresponding aperture in the casing. Each pipe has a plug arranged to be radially slidably mounted in the socket of the corresponding connector of the annular fuel manifold to allow relative radial movement between the casing and the annular fuel manifold.

20 Claims, 4 Drawing Sheets

FUEL MANIFOLD AND FUEL INJECTOR ARRANGEMENT

FIELD OF THE INVENTION

The present disclosure relates to a fuel manifold and a fuel injector arrangement and in particular relates to a fuel manifold and fuel injector arrangement for a gas turbine engine.

BACKGROUND TO THE INVENTION

Gas turbine engines have an arrangement of fuel injectors to supply fuel into the combustion chamber of the gas turbine engine and have a fuel manifold to supply fuel to the fuel injectors. In operation the fuel injectors are subjected to relatively high temperatures due to their proximity to the combustion chamber whereas the fuel manifold is subjected to relatively cold temperatures due to the relatively cold fuel within the fuel manifold which is supplied from the fuel manifold to the fuel injectors.

Thermal management of the fuel manifold and fuel injectors is required.

Fuel injectors have been provided with flexible internal fuel pipes or have been provided with internal sliding joints. Fuel injectors with flexible internal fuel pipes are bulky and it is difficult or impossible to inspect fuel injectors with flexible internal fuel pipes to determine whether they have failed. Fuel injectors with internal sliding joints invariably leak internally and the leakage of fuel leads to coking and gumming of the fuel with the possibility of deformation of the fuel injector and again it is difficult or impossible to inspect fuel injectors with internal sliding joints to determine whether they have failed.

Fuel manifolds have been made flexible by constructing the fuel manifold using fibre reinforced polymer pipes or by constructing portions of the fuel manifold from curved metal pipes, called pigtails. Fuel manifolds constructed from fibre reinforced polymer pipes are bulky and are difficult to fire proof. Fuel manifolds constructed from curved metal pipes are fragile, susceptible to handling damage, suffer from vibration and require extensive use of clips, or other types of fasteners, to secure the metal pipes to the gas turbine engine casing to reduce vibration.

Therefore the present invention seeks to provide a novel fuel manifold and fuel injector arrangement which reduces or overcomes the above mentioned problem.

STATEMENTS OF INVENTION

Accordingly the present disclosure provides a fuel manifold and fuel injector arrangement for supplying fuel to at least one combustion chamber comprising an annular combustion chamber casing arranged around the at least one combustion chamber, an annular fuel manifold and a plurality of fuel injectors, each fuel injector comprising a fuel injector head and a hollow fuel feed arm, each fuel feed arm having an end remote from the fuel injector head, the end of each fuel feed arm remote from the fuel injector head being secured to the casing, each fuel injector having a pipe to supply fuel to the fuel injector head, the pipe extending from the fuel feed arm and through a corresponding aperture in the casing, the annular fuel manifold being arranged around the casing, the annular fuel manifold comprising a plurality of connectors, each connector having a socket or a plug aligned with a corresponding aperture in the casing, each pipe having a plug or a socket arranged to be radially slidably mounted in the socket or the plug of the corresponding connector of the annular fuel manifold to allow relative radial movement between the casing and the annular fuel manifold.

Preferably each connector having a socket aligned with a corresponding aperture in the casing and each pipe having a plug arranged to be radially slidably mounted in the socket of the corresponding connector of the annular fuel manifold.

Each plug may be generally cylindrical and the socket being circular in cross-section.

Each plug may have at least one annular groove and each annular groove having an O-ring seal.

Each O-ring seal may comprise a polymeric material.

The annular fuel manifold may comprise a plurality of segments.

The annular fuel manifold may be arranged in a plane containing the apertures in the casing and each connector may be arranged to extend radially from the annular manifold. Each connector may be integral with the annular fuel manifold.

The annular fuel manifold may be arranged in a plane parallel to and spaced axially from the apertures in the casing and each connector extends axially and radially from the annular fuel manifold. Each connector may be separate from the annular fuel manifold. Each connector may comprise a plug arranged to be mounted in a socket in the annular fuel manifold. The plug of each connector may extend axially and the socket of each connector extends radially. Each connector may be L-shaped. The plug of each connector may have at least one annular groove and each annular groove having an O-ring seal. Each O-ring seal may comprise a polymeric material.

Each pipe may have a second plug arranged to be radially slidably mounted in a socket of the fuel feed arm to allow further relative radial movement between the casing and the annular fuel manifold. Each second plug may be generally cylindrical and the socket of the fuel feed arm being circular in cross-section. Each second plug may have at least one annular groove and each annular groove having an O-ring seal. Each O-ring seal may comprise a polymeric material.

The end of each fuel feed arm remote from the fuel injector head may have a flange which is secured to the casing. The flange may be arranged radially outside the casing or radially inside the casing.

BRIEF DESCRIPTION OF THE DRAWINGS

The present invention will be more fully described by way of example with reference to the accompanying drawings, in which.

DETAILED DESCRIPTION

Figure 1:
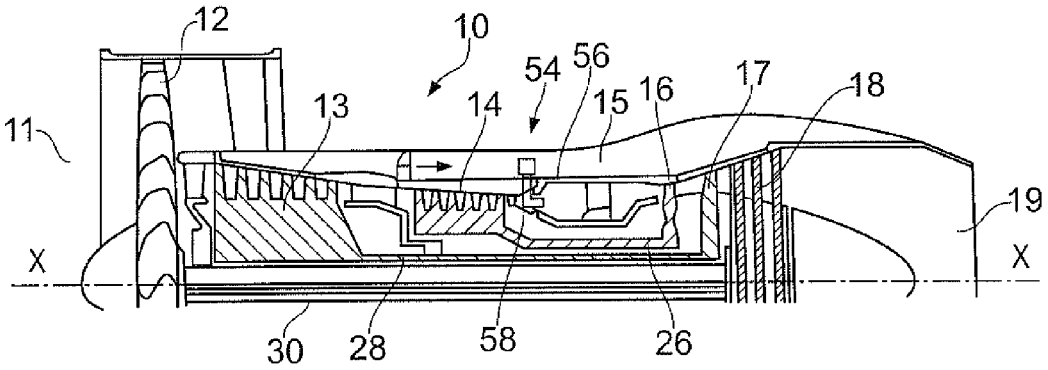
FIG. 1 is partially cut away view of a turbofan gas turbine engine having a fuel manifold and fuel injector arrangement according to the present disclosure.

A turbofan gas turbine engine 10, as shown in FIG. 1, comprises in flow series an intake 11, a fan 12, an intermediate pressure compressor 13, a high pressure compressor 14, a combustion chamber 15, a high pressure turbine 16, an intermediate pressure turbine 17, a low pressure turbine 18 and an exhaust 19. The high pressure turbine 16 is arranged to drive the high pressure compressor 14 via a first shaft 26. The intermediate pressure turbine 17 is arranged to drive the intermediate pressure compressor 13 via a second shaft 28 and the low pressure turbine 18 is arranged to drive the fan 12 via a third shaft 30. In operation air flows into the intake 11 and is compressed by the fan 12. A first portion of the air flows through, and is compressed by, the intermediate pressure compressor 13 and the high pressure compressor 14 and is supplied to the combustion chamber 15. Fuel is injected into the combustion chamber 15 and is burnt in the air to produce hot exhaust gases which flow through, and drive, the high pressure turbine 16, the intermediate pressure turbine 17 and the low pressure turbine 18. The hot exhaust gases leaving the low pressure turbine 18 flow through the exhaust 19 to provide propulsive thrust. A second portion of the air bypasses the main engine to provide propulsive thrust.

Figure 2:
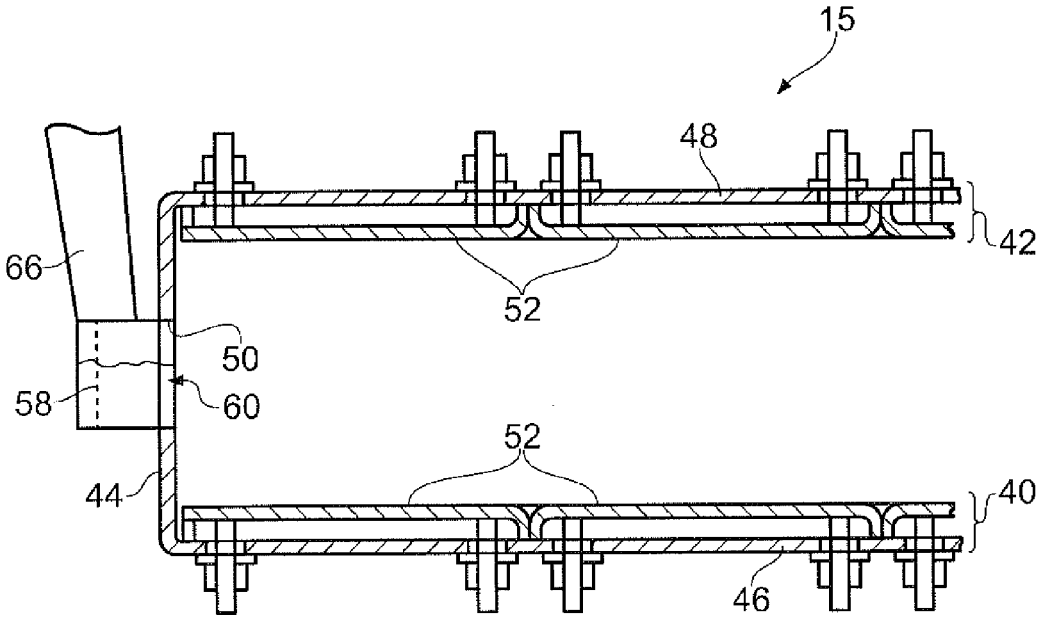
FIG. 2 is an enlarged cross-sectional view of a combustion chamber having a fuel manifold and fuel injector arrangement according to the present disclosure.
Figure 3:
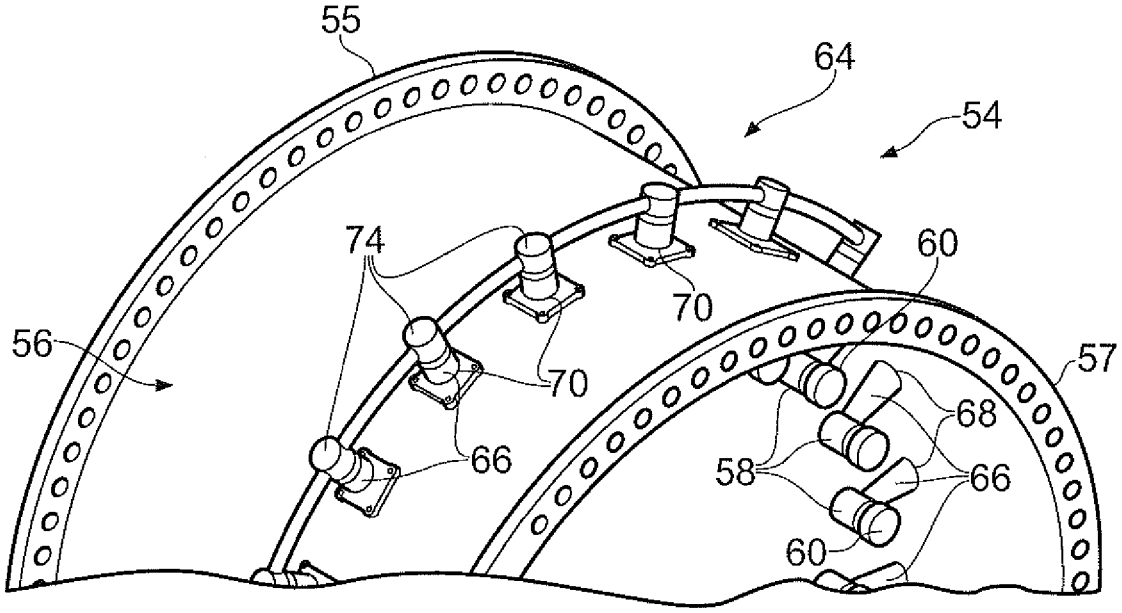
FIG. 3 is an enlarged perspective view of a portion of a fuel manifold and fuel injector arrangement according to the present disclosure.

The combustion chamber 15, as shown more clearly in FIG. 2, is an annular combustion chamber and comprises a radially inner annular wall structure 40, a radially outer annular wall structure 42 and an upstream end wall structure 44. The radially inner annular wall structure 40 comprises a first annular wall 46. The radially outer annular wall structure 42 comprises a second annular wall 48. The upstream end of the first annular wall 46 is secured to the upstream end wall structure 44 and the upstream end of the second annular wall 48 is secured to the upstream end wall structure 44. In this example the radially inner annular wall structure 40 also comprises a number of tiles 52 secured to the first annular wall 46 and the radially outer annular wall structure 42 also comprises a number of tiles 52 secured to the second annular wall 48. The upstream end wall structure 44 has a plurality of circumferentially spaced apertures 50 and each aperture 50 has a respective one of a plurality of fuel injectors 58 located therein. The apertures 50 are equi-angularly spaced around the upstream annular wall 54 and the apertures 50 are generally circular. The fuel injectors 58 are arranged to supply fuel into the annular combustion chamber 15 during operation of the gas turbine engine 10. The annular combustion chamber 15 has an axis which is coaxial with the axis X-X of the turbofan gas turbine engine 10.

A fuel manifold and fuel injector arrangement 54 for a combustion chamber 15 according to the present disclosure is shown more clearly in FIGS. 3 to 6. The combustion chamber 15 is an annular combustion chamber and an annular combustion chamber casing 56 is arranged generally coaxially around the annular combustion chamber 15 and coaxially with the axis X-X of the turbofan gas turbine engine 10. The annular combustion chamber casing 56 has a flange 55 at an upstream end and a flange 57 at a downstream end. The flanges 55 and 57 are fastened to an adjacent compressor casing (not shown) and an adjacent turbine casing (not shown) respectively via suitable fasteners, e.g. nuts, bolts and washers. A plurality of circumferentially spaced fuel injectors 58 are arranged to supply fuel into the annular combustion chamber 15 and a fuel manifold 64 is arranged to supply fuel to each of the fuel injectors 58. Each fuel injector 58 comprises a fuel feed arm 66 and a fuel injector head 60. The fuel injector head 60 of each fuel injector 58 is located in the respective aperture 50 in the upstream end wall structure 44 of the combustion chamber 15. Each fuel feed arm 66 extends through a corresponding one of a plurality of circumferentially spaced apertures 68 in the annular combustion chamber casing 56. Each fuel feed arm 66 has an associated sealing plate, or flange, 70 which is secured onto the annular combustion chamber casing 56 by suitable fasteners, e.g. bolts. The fuel injectors 58 and apertures 68 are equi-circumferentially spaced around the annular combustion chamber casing 56. Each fuel feed arm 66 is hollow and is arranged to supply fuel from the fuel manifold 64 to its associated fuel injector head 60.

The fuel manifold and fuel injector arrangement 54 comprises the annular fuel manifold 64 and the plurality of fuel injectors 58. Each fuel injector 58 comprises a fuel injector head 60 and a hollow fuel feed arm 66, as mentioned previously. Each fuel feed arm 66 is open at an end 69 remote from the fuel injector head 60 and the end 69 of each fuel feed arm 66 remote from the fuel injector head 60 is secured to the annular combustion chamber casing 56 by its flange 70. Each fuel injector 58 has a pipe 72 to supply fuel to the fuel injector head 60 and the pipe 72 extends through the fuel feed arm 66 from the fuel injector head 60 to the end 69 of the fuel feed arm 68 remote from the fuel injector head 60. The pipe 72 also extends out of and away from the fuel feed arm 66 and through a corresponding aperture 68 in the annular combustion chamber casing 56. The annular fuel manifold 64 is arranged around the annular combustion chamber casing 56 and the annular fuel manifold 64 comprises a plurality of connectors 74. Each connector 74 is integral, unitary or one piece, with the annular fuel manifold 64. Each connector 74 has a socket 76 aligned with a corresponding aperture 68 in the annular combustion chamber casing 56 and the radially outer end of each pipe 72 has a plug 78 arranged to be radially slidably mounted in the socket 76 of the corresponding connector 74 of the annular fuel manifold 64 to allow relative radial movement between the annular combustion chamber casing 56 and the annular fuel manifold 64. Each plug 78 is generally cylindrical and has a cylindrical outer surface and the corresponding socket 76 is also circular in cross-section and has a cylindrical inner surface to match and receive the plug 78. Each plug 78 has at least one annular groove 80 on its cylindrical outer surface and each annular groove 80 has an O-ring seal 82. Each O-ring seal 82 comprises a polymeric material or other suitable material which is resilient to form a seal. The O-ring seals 82 are preferably resistant to corrosion by the fuel. The annular fuel manifold 64 comprises a plurality of segments 84, see FIG. 4, to enable the annular fuel manifold 64 to be assembled. The number of segments 84 is determined by the radius of the annular combustion chamber casing 56 compared to the radius of the annular fuel manifold 64. The number of segments 84 may be equal to the number of fuel injectors 58 and in this example each segment 84 comprises one connector 74.

Figure 5:
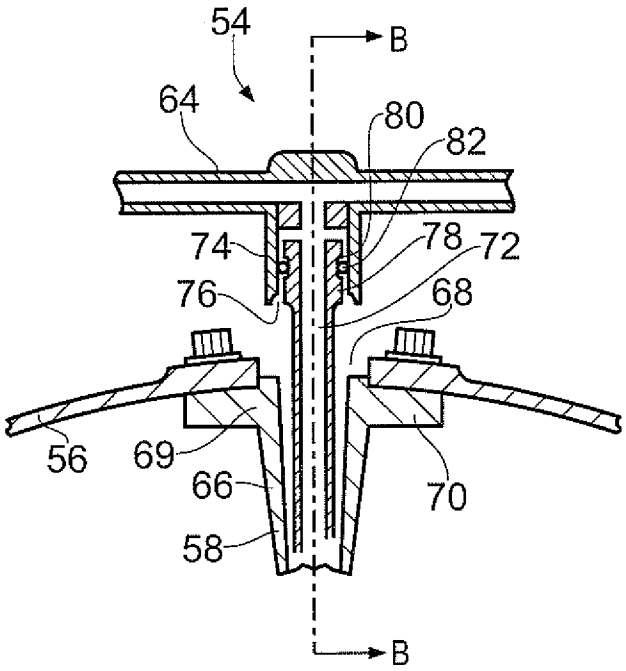
FIG. 5 is an enlarged cross-sectional view through a portion of the fuel manifold and fuel injector arrangement according to the present disclosure.
Figure 4:
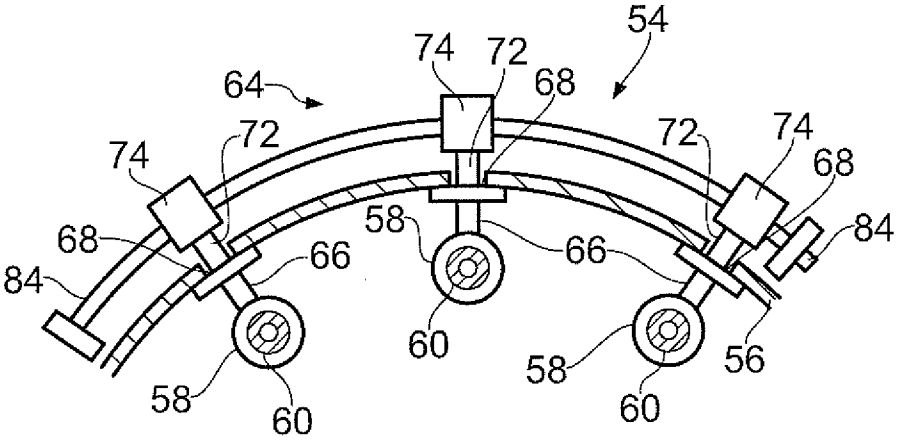
FIG. 4 is an enlarged view in the direction of arrow A in FIG. 1 showing a portion of the fuel manifold and fuel injector arrangement according to the present disclosure.
Figure 6:
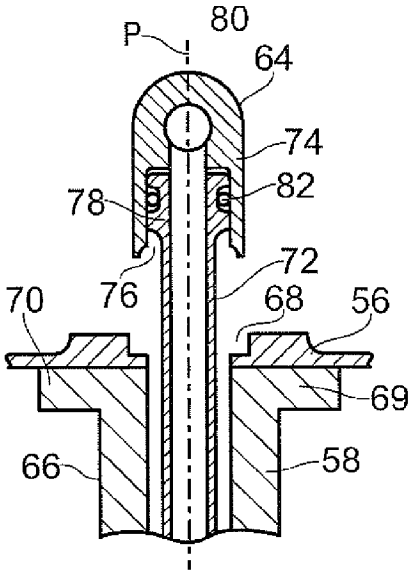
FIG. 6 is a cross-sectional view in the direction of arrows B-B in FIG. 5.

As shown in FIGS. 4, 5 and 6 the annular fuel manifold 64 is arranged in a plane P containing the apertures 68 in the annular combustion chamber casing 56 and in particular the annular fuel manifold 64 is arranged in a plane P containing the axes of the apertures 68 in the annular combustion chamber casing 56. Each connector 74 is arranged to extend radially from the annular fuel manifold 64. The plane P is a plane arranged perpendicular to the axis X-X of the turbofan gas turbine engine 10. FIG. 5 is a cross-sectional view of the fuel manifold and fuel injector arrangement 54 along plane P. Thus, the axis of each cylindrical socket 76 is arranged generally radially in the plane P and the axis of each cylindrical plug 78 is arranged generally radially in the plane P. However, there may be some movement away from this general alignment.

Figure 8:
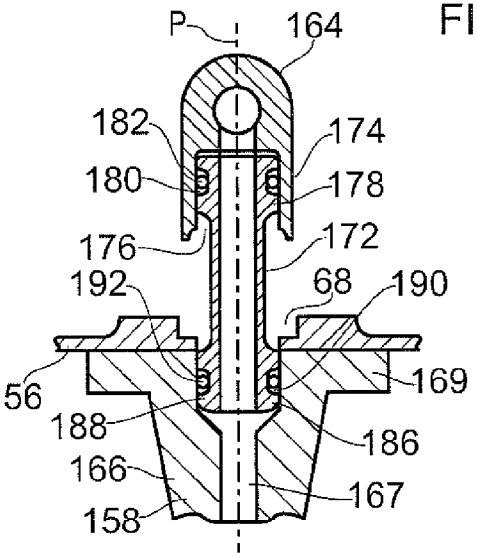
FIG. 8 is a cross-section view in the direction of arrows C-C in FIG. 7.
Figure 7:
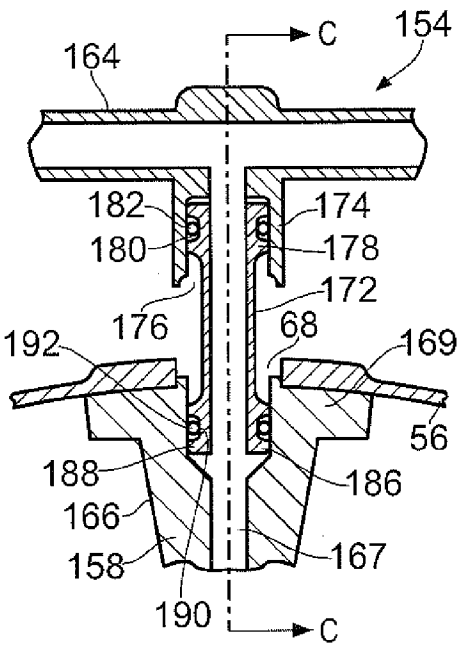
FIG. 7 is an alternative enlarged cross-sectional view through a portion of the fuel manifold and fuel injector arrangement according to the present disclosure.

A further fuel manifold and fuel injector arrangement 154 comprises an annular fuel manifold 164 and a plurality of fuel injectors 158 as shown in FIGS. 7 and 8, is similar to that shown in FIGS. 5 and 6. In FIGS. 5 and 6 each fuel injector 158 has a pipe 172 to supply fuel to the fuel feed arm 166 and the fuel feed arm 166 has a fuel duct 167 extending there-through to supply fuel to the fuel injector head 160. The pipe 172 also extends out of and away from the fuel feed arm 166 and through a corresponding aperture 68 in the annular combustion chamber casing 56. The annular fuel manifold 164 is arranged around the annular combustion chamber casing 56 and the annular fuel manifold 164 comprises a plurality of connectors 174. Each connector 174 is integral, unitary or one piece, with the annular fuel manifold 164. Each connector 174 has a socket 176 aligned with a corresponding aperture 68 in the annular combustion chamber casing 56 and the radially outer end of each pipe 172 has a plug 178 arranged to be radially slidably mounted in a socket 176 of corresponding connector 174 of the annular fuel manifold 164 to allow relative radial movement between the annular combustion chamber casing 56 and the annular fuel manifold 164. Each plug 178 is generally cylindrical and has a cylindrical outer surface and the corresponding socket 176 is also circular in cross-section and has a cylindrical inner surface to match and receive the plug 178. Each plug 178 has at least one annular groove 180 on its outer surface and each annular groove 180 has an O-ring seal 182. Each O-ring seal 182 comprises a polymeric material or other suitable material which is resilient to form a seal and is resistant to corrosion by the fuel. The annular fuel manifold 164 also comprises a plurality of segments 184, similar to those in FIG. 4. The number of segments is determined by the radius of the annular combustion chamber casing 56 compared to the radius of the annular fuel manifold 164. The number of segments may be equal to the number of fuel injectors 58 and each segment would comprise one connector 174.

The radially inner end of each pipe 172 has a second plug 186 arranged to be radially slidably mounted in a socket 188 in the end 169 of the fuel feed arm 166 to allow further relative radial movement between the annular combustion chamber casing 56 and the annular fuel manifold 164. Each second plug 186 is generally cylindrical and has a cylindrical outer surface and the socket 188 of the fuel feed arm 166 is circular in cross-section and has a cylindrical inner surface to match and receive the plug 186. Each second plug 186 has at least one annular groove 190 on its outer surface and each annular groove 190 has an O-ring seal 192. Each O-ring seal 192 comprises a polymeric material or other suitable material which is resilient to form a seal and is resistant to corrosion by the fuel.

The annular fuel manifold 164 is also arranged in a plane P containing the apertures 68 in the annular combustion chamber casing 56 and in particular the annular fuel manifold 164 is arranged in a plane P containing the axes of the apertures 68 in the annular combustion chamber casing 56. Each connector 174 is arranged to extend radially from the annular fuel manifold 164. The plane P is a plane arranged perpendicular to the axis X-X of the turbofan gas turbine engine 10. FIG. 7 is a cross-sectional view of the fuel manifold and fuel injector arrangement 154 along plane P. Thus, the axis of each cylindrical socket 176 is arranged generally radially in the plane P and the axis of each cylindrical plug 178 is arranged generally radially in the plane P. Also, the axis of each cylindrical socket 188 is arranged generally radially in the plane P and the axis of each cylindrical plug 186 is arranged generally radially in the plane P. However, there may be some movement away from this general alignment.

The fuel manifold and fuel injector arrangement 154 provides pipes 172 which have plugs 178 and 186 at both ends of the pipes 172 to connect the fuel injectors 158 to the annular fuel manifold 164. The pipes 172 provide resilience and allow some angular mismatch between the fuel feed arms 166 of the fuel injectors 158 and the connectors 174 on the annular fuel manifold to be accommodated during assembly of the fuel manifold and fuel injector arrangement 154 and also enables the annular fuel manifold 164 to have fewer segments.

Figure 9:
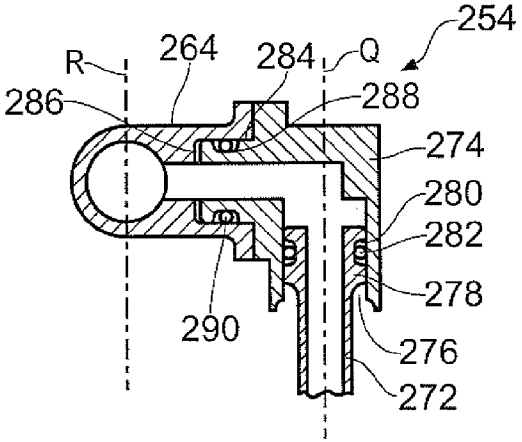
FIG. 9 is a further alternative enlarged cross-sectional view through a portion of the fuel manifold and fuel injector arrangement according to the present disclosure.

Another fuel manifold and fuel injector arrangement 154 comprises an annular fuel manifold 264 and a plurality of fuel injectors (not shown) as shown in FIG. 9, is similar to that shown in FIGS. 5 and 6. In FIG. 9 each fuel injector (not shown) has a pipe 272 to supply fuel to the fuel injector (not shown). Each pipe 272 extends from the remote end of the fuel feed arm through a corresponding aperture 68 in the annular combustion chamber casing 56. The annular fuel manifold 264 is arranged around the annular combustion chamber casing 56 and the annular fuel manifold 264 comprises a plurality of connectors 274. Each connector 274 has a socket 276 aligned with a corresponding aperture 68 in the annular combustion chamber casing 56 and the radially outer end of each pipe 272 has a plug 278 arranged to be radially slidably mounted in a socket 276 of the corresponding connector 274 of the annular fuel manifold 264 to allow relative radial movement between the annular combustion chamber casing 56 and the annular fuel manifold 264. Each plug 278 is generally cylindrical and has a cylindrical outer surface and the corresponding socket 276 is also circular in cross-section and has a cylindrical inner surface to match and receive the plug 278. Each plug 278 has at least one annular groove 280 on its cylindrical outer surface and each annular groove 280 has an O-ring seal 282. Each O-ring seal 282 comprises a polymeric material or other suitable material which is resilient to form a seal and is resistant to corrosion by the fuel. The annular fuel manifold 264 also comprises a plurality of segments, similar to those in FIG. 4. The number of segments is determined by the radius of the annular combustion chamber casing 56 compared to the radius of the annular fuel manifold 264. The number of segments may be equal to the number of fuel injectors 58 and each segment would comprise one connector 274.

The annular fuel manifold 264 is arranged in a plane R parallel to and spaced axially from the apertures 68 in the annular combustion chamber casing 56 and each connector 274 extends axially and radially from the annular fuel manifold 264. In particular the annular fuel manifold 264 is arranged in a plane R parallel and spaced axially from the plane Q containing the axes of the apertures 68 in the annular combustion chamber casing 56. Each connector 274 is separate from the annular fuel manifold 264. Each connector 274 comprises a plug 284 arranged to be mounted in a socket 286 in the annular fuel manifold 264. The plug 284 of each connector 274 extends axially and the socket 276 of each connector 274 extends radially and thus each connector 274 is substantially L-shaped. The plug 284 of each connector 274 has a generally cylindrical outer surface and the outer surface of each plug 284 has at least one annular groove 288 and each annular groove 288 has an O-ring seal 290. Each socket 286 is generally cylindrical and has a cylindrical inner surface to match and receive the corresponding plug 284. Each O-ring seal 290 comprises a polymeric material or other suitable material which is resilient to form a seal and is resistant to corrosion by the fuel. Each connector 274 is secured to the annular fuel manifold 264 by securing the flange on each connector 274 to a corresponding flange on the annular fuel manifold 264 using suitable fasteners, e.g. nuts and bolts.

The fuel manifold and fuel injector arrangement 254 provides L-shaped connectors 274 which are separate from the annular fuel manifold 264 and positions the annular fuel manifold 264 in a plane spaced axially from the plane of the apertures 68 in the annular combustion chamber casing 56. This arrangement enables easier assembly of the fuel manifold and fuel injector arrangement 254. Alternatively, each connector 274 comprises a socket arranged to be mounted on/or receive a plug on the annular fuel manifold 264.

However it is possible that each connector 274 may be integral with the annular fuel manifold 264.

Although in each of the fuel manifold and fuel injector arrangements described above the annular fuel manifold comprises a plurality of connectors integral with the fuel manifold it is equally possible for each of these fuel manifold and fuel injector arrangements to comprise a plurality of separate connectors and arrange the adjacent connectors to be interconnected by separate fuel pipes.

In each of the fuel manifold and fuel injector arrangements described above where a single annular groove and corresponding O-ring seal is provided, it is equally possible to provide two or more annular grooves each of which has an O-ring seal to provide higher integrity sealing. The O-ring seals may be circular in cross-section or may be rectangular, square, in cross-section.

In addition a hard anti-extrusion ring may be included in the plug and socket arrangements in each of the fuel manifold and fuel injector arrangements described above to provide higher integrity sealing.

Although the present disclosure has referred to cylindrical plug and socket arrangements it may be possible to provide other suitable types of plug and socket for example the plug and socket may be rectangular outer and inner surfaces respectively or the plug may have a spherical outer surface and the socket may have a cylindrical inner surface to allow lateral movement.

In the present disclosure the joint, connection, between the fuel manifold, the annular fuel manifold, and the fuel injectors is achieved using junctions, connections, where the mating parts are able to move, slide, radially relative to each other. Variations in the diameter of the annular combustion chamber casing and/or the diameter of the annular fuel manifold for whatever reason are accommodated by radial movement, radial sliding, of the mating parts, e.g. the plug and socket, and concentricity of the annular combustion chamber casing and annular fuel manifold may be maintained. The variations in diameter of the annular combustion chamber casing and the annular fuel manifold may be due to differential thermal responses and/or manufacturing tolerances. The fuel manifold and fuel injector arrangement accommodates these differences at a single point for each fuel injector and thus reduces the number of sealing positions required for assembly of the fuel manifold and fuel injector assembly. The present disclosure dispenses with the need for the curved metal pipes, pigtails, and their associated clips and simplifies assembly and reduces weight. The present disclosure also increases vibration damping and improves inspectability.

Although the present disclosure has referred to an annular combustion chamber having a plurality of fuel injectors it is equally applicable to a tubo-annular combustion chamber or to a plurality of tubular combustion chambers each of which has a single fuel injector.

Although the present disclosure has been described with reference to the use of a plug on the pipe and a socket in the connector it is equally possible to provide a plug on the connector and a socket on the pipe.

Although the end of each fuel feed arm remote from the fuel injector head has a flange which is secured to the annular combustion chamber casing on the radially inside of the annular combustion chamber casing, it is equally possible for the flange at the end of each fuel feed arm remote from the fuel injector head to be secured on the radially outside of the annular combustion chamber casing.

The gas turbine engine may be an aero gas turbine engine, a marine gas turbine engine, an industrial gas turbine engine or an automotive gas turbine engine. The aero gas turbine engine may be a turbofan gas turbine engine, a turboprop gas turbine engine, a turbojet gas turbine engine or a turboshaft gas turbine engine.

The invention claimed is:

1. A fuel manifold and fuel injector arrangement for supplying fuel to at least one combustion chamber comprising an annular combustion chamber casing arranged around the at least one combustion chamber, an annular fuel manifold and a plurality of fuel injectors, each fuel injector comprising a fuel injector head and a hollow fuel feed arm, each fuel feed arm having an end remote from the fuel injector head, the end of each fuel feed arm remote from the fuel injector head being secured to the casing, each fuel injector having a pipe to supply fuel to the fuel injector head, the pipe extending from the fuel feed arm and through a corresponding aperture in the casing, the annular fuel manifold being arranged around the casing, the annular fuel manifold comprising a plurality of connectors, each connector having a socket or a plug aligned with a corresponding aperture in the casing, each pipe having a plug or a socket arranged to be radially slidably mounted in the socket or the plug of the corresponding connector of the annular fuel manifold to allow relative radial movement between the casing and the annular fuel manifold.

2. An arrangement as claimed in claim 1 wherein each connector has a socket aligned with a corresponding aperture in the casing and each pipe has a plug arranged to be radially slidably mounted in the socket of the corresponding connector of the annular fuel manifold.

3. An arrangement as claimed in claim 1 wherein each plug is generally cylindrical and the socket is circular in cross-section.

4. An arrangement as claimed in claim 1 wherein each plug has at least one annular groove and each annular groove has an O-ring seal.

5. An arrangement as claimed in claim 1 wherein the annular fuel manifold comprises a plurality of segments.

6. An arrangement as claimed in claim 1 wherein the annular fuel manifold is arranged in a plane containing the apertures in the casing and each connector is arranged to extend radially from the annular fuel manifold.

7. An arrangement as claimed in claim 1 wherein each connector is integral with the annular fuel manifold.

8. An arrangement as claimed in claim 1 wherein the annular fuel manifold is arranged in a plane parallel to and spaced axially from the apertures in the casing and each connector extends axially and radially from the annular fuel manifold.

9. An arrangement as claimed in claim 8 wherein each connector is separate from the annular fuel manifold.

10. An arrangement as claimed in claim 9 wherein each connector comprises a plug arranged to be mounted in a socket in the annular fuel manifold.

11. An arrangement as claimed in claim 10 wherein the plug of each connector extends axially and the socket of each connector extends radially.

12. An arrangement as claimed in claim 11 wherein each connector is L-shaped.

13. An arrangement as claimed in claim 10 wherein the plug of each connector has at least one annular groove and each annular groove has an O-ring seal.

14. An arrangement as claimed in claim 1 wherein each pipe has a second plug arranged to be radially slidably mounted in a socket of the fuel feed arm to allow further relative radial movement between the casing and the annular fuel manifold.

15. An arrangement as claimed in claim 14 wherein each second plug is generally cylindrical and the socket of the fuel feed arm is circular in cross-section.

16. An arrangement as claimed in claim 15 wherein each second plug has at least one annular groove and each annular groove has an O-ring seal.

17. An arrangement as claimed in claim 1 wherein the end of each fuel feed arm remote from the fuel injector head has a flange which is secured to the casing.

18. An arrangement as claimed in claim 17 wherein the flange is arranged radially outside the casing.

19. An arrangement as claimed in claim 17 wherein the flange is arranged radially inside the casing.

20. A gas turbine engine comprising an arrangement as claimed in claim 1.

* * * * *